US009138629B2

(12) United States Patent
Rosenberger

(10) Patent No.: US 9,138,629 B2
(45) Date of Patent: Sep. 22, 2015

(54) RIB-STIFFENED SPORTS BOARD

(71) Applicant: Brian Rosenberger, Aledo, TX (US)

(72) Inventor: Brian Rosenberger, Aledo, TX (US)

( * ) Notice: Subject to any disclaimer, the term of this patent is extended or adjusted under 35 U.S.C. 154(b) by 0 days.

(21) Appl. No.: 14/214,416

(22) Filed: Mar. 14, 2014

(65) Prior Publication Data

US 2014/0265174 A1 Sep. 18, 2014

Related U.S. Application Data

(60) Provisional application No. 61/801,194, filed on Mar. 15, 2013.

(51) Int. Cl.
*A63C 1/00* (2006.01)
*A63C 5/044* (2006.01)
*A63C 5/12* (2006.01)

(52) U.S. Cl.
CPC ..... *A63C 5/044* (2013.01); *A63C 5/126* (2013.01); *Y10T 29/49778* (2015.01)

(58) Field of Classification Search
CPC ..... A63C 17/02
USPC ..... 280/11.3, 601, 600, 603, 607–609, 280/14.21–14.22, 14.24, 810, 845, 818
See application file for complete search history.

(56) References Cited

U.S. PATENT DOCUMENTS

| | | | | |
|---|---|---|---|---|
| 4,545,597 | A | 10/1985 | Meatto et al. | |
| 4,688,821 | A * | 8/1987 | Meatto et al. | 280/609 |
| 5,335,931 | A * | 8/1994 | Lacroix et al. | 280/602 |
| 5,823,562 | A * | 10/1998 | Stubblefield | 280/609 |
| 6,245,274 | B1 * | 6/2001 | Huybrechts et al. | 264/257 |
| 6,382,658 | B1 * | 5/2002 | Stubblefield | 280/609 |
| 6,502,850 | B1 | 1/2003 | Schaller et al. | |
| 6,520,530 | B1 * | 2/2003 | Dodge et al. | 280/610 |
| 6,626,444 | B2 | 9/2003 | Noble | |
| 7,073,811 | B2 * | 7/2006 | Puget | 280/610 |
| 7,213,828 | B2 | 5/2007 | Riepler et al. | |
| 7,390,009 | B2 * | 6/2008 | Trimble et al. | 280/608 |
| 7,396,036 | B2 * | 7/2008 | Barbieri et al. | 280/601 |
| 7,422,228 | B2 * | 9/2008 | Cheung | 280/609 |
| 7,562,894 | B2 * | 7/2009 | Krafft | 280/609 |
| 8,517,410 | B2 | 8/2013 | Pederson et al. | |
| 8,523,205 | B2 * | 9/2013 | Hsu et al. | 280/87.042 |
| 2007/0218787 | A1 | 9/2007 | Carter et al. | |

FOREIGN PATENT DOCUMENTS

EP 1058573 B1 6/2003

OTHER PUBLICATIONS

Image capture from Volant Skis website. URL: http://www.volantski.com/season1314/en/#!/hor/left/ski-pulse-white Author Unknown, title unknown, date unknown.

* cited by examiner

*Primary Examiner* — John Walters
*Assistant Examiner* — James Triggs
(74) *Attorney, Agent, or Firm* — Eric Karich; Karich & Associates

(57) ABSTRACT

A sports board has a board body having a top surface and an opposed bottom surface, a binding attachment structure formed on or in the board body, and a plurality of ribs collectively having longitudinal portions and transverse portions each having a thickness and a height that are predetermined to provide the sports board with a preselected longitudinal, transverse, and torsional stiffness desirable for sliding on the snow.

7 Claims, 4 Drawing Sheets

RIB-STIFFENED SPORTS BOARD

CROSS-REFERENCE TO RELATED APPLICATIONS

This application for a utility patent claims the benefit of U.S. Provisional Application No. 61/801,194, filed Mar. 15, 2013.

BACKGROUND OF THE INVENTION

1. Field of the Invention

This invention relates generally to boards that a user may ride on a snow surface, such as snowboards, skis, and similar boards.

2. Description of Related Art

Various forms of boards for sliding on snow are known in the art. For purposes of this application, the term "snow board" is hereby defined to include any form of snow board, ski, and other board-type devices that allow a user to slide along a snow covered surface.

Riepler, U.S. Pat. No. 7,213,828, describes a board (e.g., ski, jumping ski or snowboard) that includes a running surface lining, a top layer, and several layers disposed between the running surface lining and the top layer. The running surface lining and the top layer have an external face facing away from a core. At least one of the external faces has an at least partially structured surface with a plurality of recesses. The recesses have a depth smaller than the thickness of the running surface lining and the top layer, and an annular rounded transition region surrounds the recesses, the rounded transition region having an arcuate contour which is convex relative to the external face.

Cheung, U.S. Pat. No. 7,422,228, describes a sports board that includes an expanded polymer foam core, an extruded thermoplastic polymer outer layer, an expanded polymer foam intermediate layer. The outer surface of the outer layer has a series of longitudinally extending, parallel and alternating grooves and ribs. The series has a width and the grooves and ribs spaced across the width so as to provide from about ten to about eighty grooves per inch of the width. The grooves may be spaced so as to provide about forty-five grooves per inch of the width. The grooves may have a depth of from about 0.05 mm to about 1 mm.

Carter, U.S. 2007/0218787, describes a fiberglass covered recreational board having increased strength and rigidity provided by a longitudinal, central band or bands of higher strength glass fibers such as S Glass and S-2 Glass, or by aramid fibers, or by quartz fibers that are woven into the fiberglass cover as warp threads.

Hall, E. P. 1,058,573, describes a ski board having geometrically controlled torsion and flex. A top surface of the ski board is contoured to have a raised profile area extending from a tip of the ski towards the center of the ski, and another raised profile area extending from the tail towards the center of the ski. The top surface of the ski board is further contoured to have concave areas extending laterally from opposite sides of each of the raised profile areas to the edges of the ski board. In this manner, the front region and rear region of the ski board are each provided with a stiff central portion and a torsionally soft portion on either side of the stiff central portion. The soft torsional characteristics of the ski allow it to twist around the stiff central portions, providing increased edge contact with the snow, which in turn increases the stability of the ski.

Pedersen, U.S. Pat. No. 8,517,410, describes a sport board having a running surface which provides improved steering and directional control of the sport board. The sport board may have an arcuate bottom with a series of alternating ribs and grooves. The central ribs and grooves run parallel to the longitudinal axis of the board, while the ribs and grooves in the side areas run perpendicular to the longitudinal axis of the board. In a second embodiment, the sport board comprises a bottom having a small number of a larger ribs and grooves which arrangement provides better control. By use of either approach, however, turning and cornering of the board is more controllable. The sport board has a foam core, and a harder polymer outer shell, wherein a running surface is preferably laminated to the bottom of the board, wherein said laminated running surface comprises a series of longitudinally extending, parallel and alternating grooves and ribs provided across the running surface. As such, in a first aspect, the present invention provides a convertible sport board having a polymer shell, wherein a running surface is preferably laminated to the bottom of the board, wherein said laminated running surface comprises a series of longitudinally extending grooves on the running surface to provide improved gliding and turning properties which allow the sport board to be used as a snowboard.

The above-described references are hereby incorporated by reference in full.

The prior art teaches sport boards with structural enhancements. However, the prior art does not teach longitudinal and transverse ribs and a method of calculating the size and position of said ribs to create a specific stiffness profile. The present invention fulfills these needs and provides further advantages as described in the following summary.

SUMMARY OF THE INVENTION

The present invention teaches certain benefits in construction and use which give rise to the objectives described below.

The present invention provides a sports board having a board body and a plurality of ribs. The board body has a top surface and an opposed bottom surface that extend to a perimeter. The board body has a front end and a back end extending along a longitudinal axis, and opposed side edges that are separated along a transverse axis perpendicular to the longitudinal axis. The plurality of ribs collectively have longitudinal portions and transverse portions each having a thickness and a height that are predetermined to provide the sports board with a preselected longitudinal stiffness, transverse stiffness, and torsional stiffness optimized for riding on the snow.

A primary objective of the present invention is to provide a sports board having advantages not taught by the prior art.

Another objective is to provide a sports board with a plurality of ribs selected to give the sports board a predetermined stiffness profile.

A further objective is to provide a sports board with a coating to lower the coefficient of friction between the sports board and the surface upon which the sports board is to be used.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a sports board 10 for use by a rider for riding on snow or a similar surface.

Figure 1:
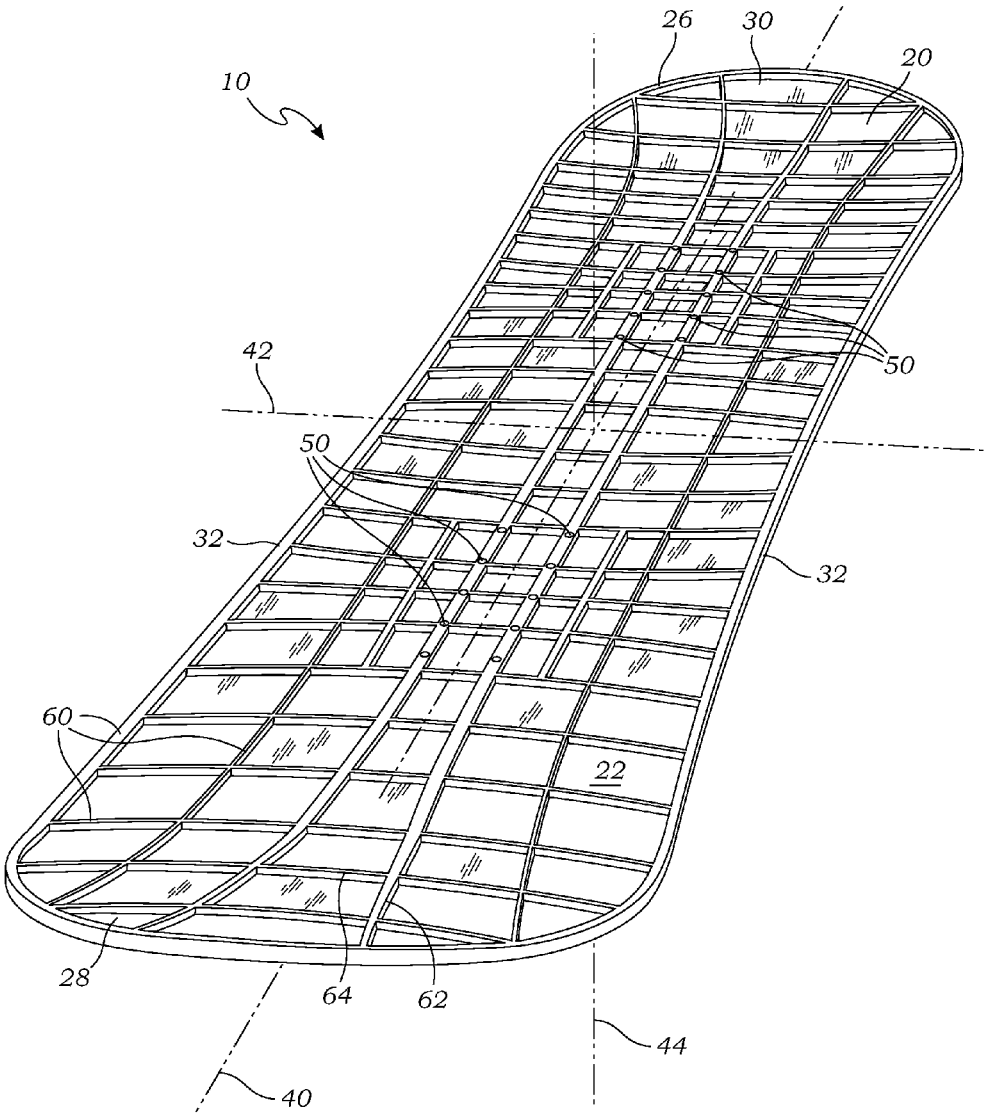
FIG. 1 is a perspective view of a sports board according to one embodiment of the present invention, illustrating a board body having a plurality of ribs that provide a preselected longitudinal, traverse, and torsional stiffness to the sports board.
Figure 2:
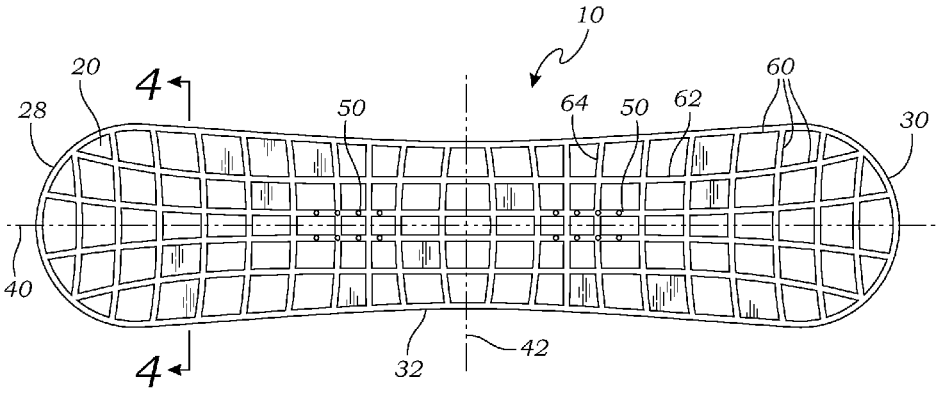
FIG. 2 is a top plan view thereof.
Figure 3:
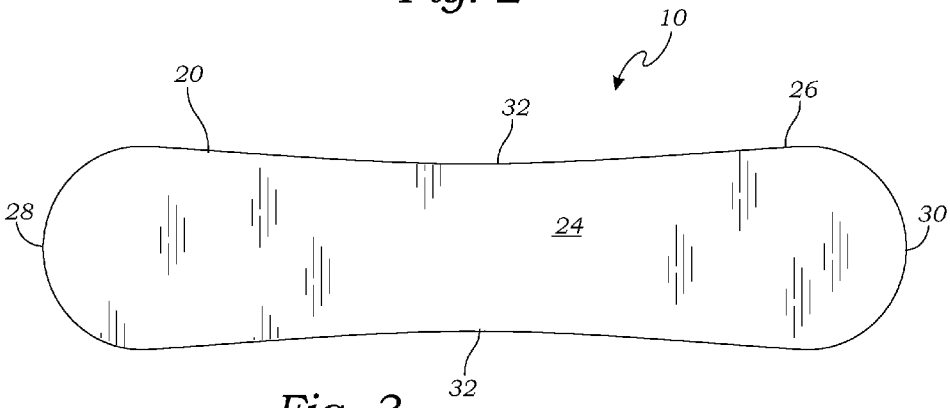
FIG. 3 is a bottom plan view thereof.
Figure 4:
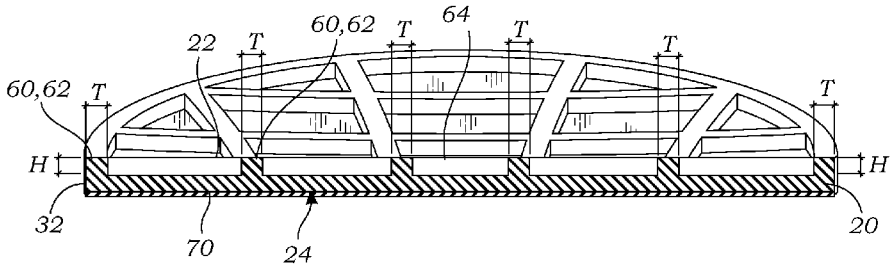
FIG. 4 is a sectional view thereof taken along line 4-4 in FIG. 3.

FIG. 1 is a perspective view of the sports board 10 according to one embodiment of the present invention, illustrating a board body 20 having a plurality of ribs 60 that provide a is preselected longitudinal, traverse, and torsional stiffness to the sports board 10. FIG. 2 is a top plan view thereof. FIG. 3 is a bottom plan view thereof. FIG. 4 is a sectional view thereof taken along line 4-4 in FIG. 3. As illustrated in FIGS. 1-4, the plurality of ribs 60 are sized, shaped, and formed to optimize the stiffness of the sports board 10, as described below.

In the embodiment of FIGS. 1-4, the board body 20 includes a top surface 22 and an opposed bottom surface 24 that extend to a perimeter 26. The board body 20 includes a front end 28 and a back end 30 extending along a longitudinal axis 40, and opposed side edges 32 that are separated along a transverse axis 42 perpendicular to the longitudinal axis 40. The longitudinal axis 40 and the transverse axis 42 define a base plane 46 from which a normal axis 44 extends normal to the base plane 46, and wherein the plurality of ribs 60 extend upwardly from the board body 20 along the normal axis 44. The top surface 22 is adapted to support the rider, whereas the bottom surface 24 is the surface in contact with whatever surface the sports board 10 is sliding upon.

The board body 20 may be constructed in many ways, and of a variety of materials. In one embodiment, the board body 20 is a monolithic construction from an isotropic material. The board body 20 may be constructed of a metal (e.g., aluminum, titanium, steel, etc.), thermoplastic polymers, thermoset polymers, and/or any other materials deemed suitable by one skilled in the art. Additionally, the materials, such as the polymers, may incorporate additional materials, such as short fiber reinforcements (e.g., carbon fibers, etc.). In alternative embodiments, however, alternative materials may be used.

The thickness of the board body 20 may be varied by one skilled in the art, depending on the application and the materials chosen. In one embodiment, the board body 20 may be between 1.0-5.0 mm thick, and may preferably be 1.0-2.0 mm thick. While FIGS. 1-4 illustrates one embodiment of the board body 20, those skilled in the art may devise alternative embodiments, and these alternative or equivalent are considered within the scope of the present invention.

The sports board 10 may include a binding attachment structure 50 formed on or in the board body 20 for attaching bindings (not shown) or similar structures to the board body 20. In this embodiment, the binding attachment structure 50 may be threaded holes for mounting bindings to the sports board 10; however, any manner of binding attachment structure 50 may be used. While FIGS. 1-4 illustrate one embodiment of the binding attachment structure 50, those skilled in the art may devise alternative embodiments, and these alternative or equivalent are considered within the scope of the present invention.

The sports board 10 is shaped and structured to have particular mechanical properties to optimize the performance of the sports board 10. In particular, the sports board 10 includes the plurality of ribs 60 described above to optimize the board body 20 to have a preselected longitudinal, transverse, and torsional stiffness desirable for sliding on the snow. The plurality of ribs 60 collectively have longitudinal portions 62 and transverse portions 64 each having a thickness T and a height H that are predetermined to provide the sports board 10 with the desired characteristics.

The ribs 60 may be oriented or shaped in a variety of configurations to tailor the local stiffness of the board. In the present embodiment, the ribs 60 extend upwardly from the top surface 22 and include separately formed longitudinal portions 62 and transverse portions 64 that are generally disposed on the longitudinal axis 40 and the transverse axis 42, respectively. In alternative embodiments, however, the ribs 60 may be disposed in alternative configurations, they may be disposed on angles to these axes, and/or they may be curved so that each rib 60 includes both longitudinal portions and transverse portions.

The shape of the cross section of the ribs 60 of the present embodiment is rectangular, although in other embodiments they may have alternative cross-sectional shapes. In one embodiment, the thickness T of the ribs 60 may be between 2.0 and 15.0 mm, and the height H may be between 2.0 mm. and 12.0 mm. The perimeter 26 of the sports board 10 may also have one of the ribs 60 extending from the top surface 22 and following the perimeter 26 of the sports board 10. While FIGS. 1-4 illustrates one embodiment of the ribs 60, those skilled in the art may devise alternative embodiments, and these alternative or equivalent are considered within the scope of the present invention.

The bottom surface 24 of the sports board 10 should be suitable for sliding on the snow or whatever surface the sports board 10 is sliding upon. As one example, in the case of using the sports board 10 as a snowboard, the bottom surface 24 may have a coefficient of friction on ice of between 0.0 and 0.06. In other embodiments, this range may change, but should generally be within a range suitable for allowing the sports board 10 to easily slide over the surface in question.

Other features, for example contouring the bottom surface 24, can be incorporated during the machining process to improve the performance of the sports board 10. Aesthetic characteristics and other performance characteristics can be achieved by coating 70, painting, laser engraving, and other appropriate processes, though any coating 70 and/or treatment processes for altering the bottom surface 24 of the sports board 10 may be used. One example is the use of hard anodizing to impart color and low friction characteristics to an aluminum sports board 10. Over the surface that has been anodized, the coating 70 may then be added to provide a surface with a lower coefficient of friction when placed upon the surface where the board will be used. For example, in the case of a snowboard, the coating 70 may create a coefficient of friction between the coating 70 and ice, which is less than the coefficient of friction between the ice and the bottom surface 24 without the coating 70, and wherein the coefficient of friction between the coating 70 and ice is greater than zero. Many types of friction reducing coating 70 may be used, for example a powder coat, paint, or other suitable material selected by one skilled in the art. In one embodiment, wherein the board body is made of titanium, the coating is polytetrafluoroethylene. In another embodiment, wherein the board body is aluminum, the coating of polytetrafluoroethylene (i.e., Teflon®) is applied to the bottom surface 24 after the bottom surface 24 has been had anodized.

In other embodiments, the bottom surface 24 may not require a separate material, but may just be provided by the surface of the board body 20. While FIGS. 1-4 illustrate one embodiment of the present invention, those skilled in the art may devise alternative embodiments, and these alternative or equivalent are considered within the scope of the present invention.

Figure 5:
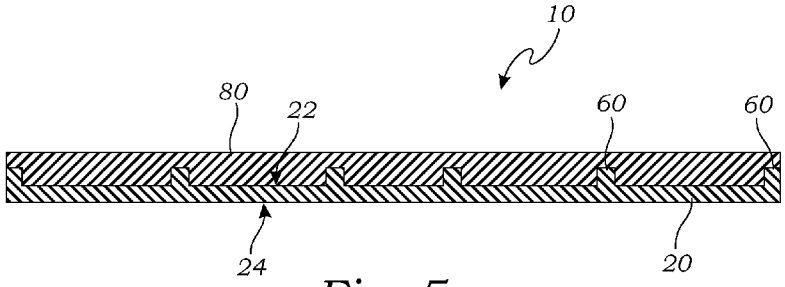
FIG. 5 is a sectional view of a second embodiment of the sports board, illustrating a top cover layer installed over a top surface of the sports board.

FIG. 5 is a sectional view of a second embodiment of the sports board 10, wherein the board body 20 further includes a top cover layer 80 installed over the top surface 22 of the sports board 10, covering the ribs 60. The top cover layer 80 may cover the ribs 20 for aesthetic purposes, and/or for preventing snow from accumulating between the ribs 60. The top cover layer 80 may be formed of any suitable material (e.g., rubber, foam, urethane, plastic, and/or any other material deemed suitable by one skilled in the art). The top cover layer 80 may be attached in any manner known to one skilled in the art (e.g., an adhesive, molded, chemically bonded, and/or otherwise affixed to the board body 20). The top cover layer 80 may also interlock with some or all of the ribs 60. While FIG. 5 illustrates one embodiment of the top cover layer 80, those skilled in the art may devise alternative embodiments, and these alternative or equivalent are considered within the scope of the present invention.

Figure 6:
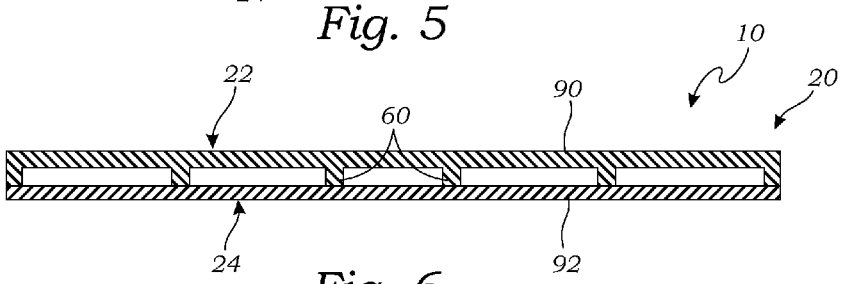
FIG. 6 is a sectional view a third embodiment of the sports board, wherein the sports board is constructed of a top body portion and a bottom body portion, and wherein the plurality of ribs extend from the top body portion of the sports board.

FIG. 6 is a sectional view a third embodiment of the sports board 10, wherein the board body 20 is constructed of a top body portion 90 and a bottom body portion 92, and wherein the plurality of ribs 60 extend downwardly from the top body portion 92 of the sports board 10. In this embodiment, the top body portion 90 and the bottom body portion 92 may be attached together to form a single unit. While FIG. 6 illustrates one embodiment of the top body portion 90 and the bottom body portion 92, those skilled in the art may devise alternative embodiments, and these alternative or equivalent are considered within the scope of the present invention.

Figure 7:
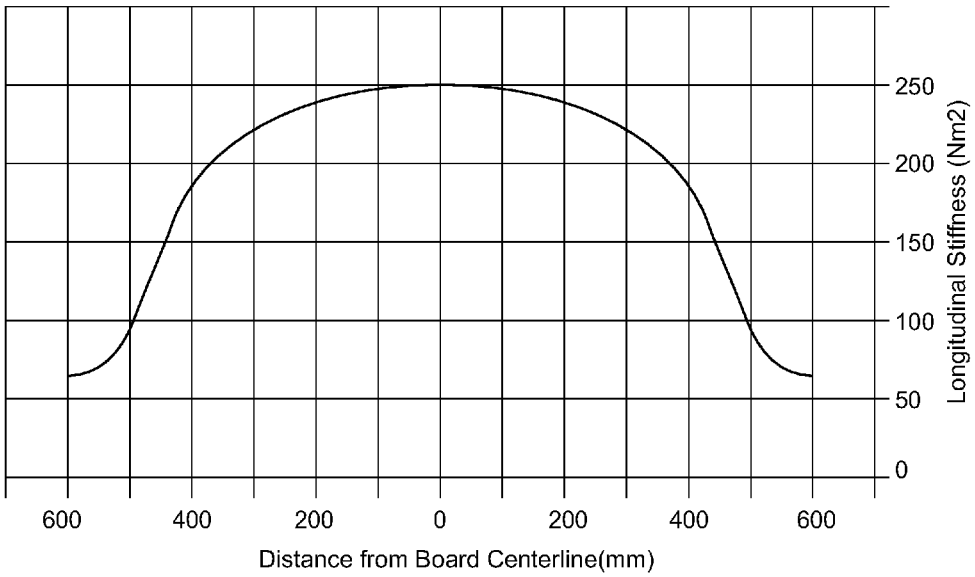
FIG. 7 is a graph of the longitudinal stiffness of the sports board at different distances along a longitudinal axis of the sports board, in one embodiment of the present invention.

FIG. 7 is a graph of the longitudinal stiffness of the sports board 10 at different distances along the longitudinal axis 40 of the sports board 10, in one embodiment of the present invention. The board body 20 and the ribs 60 described above are formed to provide the desired characteristics. While the illustrated graph teaches one possible design, a skilled rider may prefer that the sports board 10 have different characteristics. Also, while the simple example of the longitudinal stiffness profile is described in detail herein, a stiffness profile may be determined at any point or for any set of points. This allows for variations in the stiffness profile taken along any cross-section of the sports board 10.

One possible methodology for designing the ribs 60 described above is described below:

1. A desired longitudinal stiffness distribution is determined by a designer of the sports board 10, such as the design illustrated in FIG. 7. The stiffness (or flexural rigidity) is calculated by multiplying the modulus of the material (E) by the area moment of inertia (I) of a cross-section of the board at a given location.

$$\text{stiffness}=EI \tag{1}$$

2. From the above equation it is possible to calculate the required area moment of inertia for any cross-section of the sports board 10 if the modulus of the material is also known $$I=\text{stiffness}/E. \tag{2}$$

The modulus of all candidate materials is well-documented in a number of materials databases. Example: using FIG. 7 for the desired stiffness distribution, it can be seen that, at the midpoint of the longitudinal axis 40, a stiffness of 250 $Nm^2$ is desired. If this number is divided by the modulus of aluminum in metric units, a desired area moment of inertia (in units $m^4$) along the longitudinal axis 40 results.

3. A cross-sectional drawing for the desired location is created and its area moment of inertia is calculated using any appropriate method. Most computer aided design (CAD) systems contain functionality which quickly calculates the area moment of inertia for any two-dimensional geometric object (such as the sports board cross-section).

4. The area moment of inertia for the cross-section is compared to the desired value.

5. The cross-section is modified until its area moment of inertia matches the desired value.

6. This process is repeated for multiple different locations along the sport board 10 length until a number of cross-sections have been created.

7. Ribs 60 are then drawn which connect the geometric elements of the cross-sections in a smooth or faired manner. The result is a board geometry containing ribs 60 as shown in FIGS. 1-4. In this embodiment, there are two main longitudinal ribs 60 which vary in both height H and thickness T, and two other full-length constant width longitudinal ribs 60 which vary in height H. These ribs 60 were developed using nine different cross-sectional geometries spaced along the length of the board.

The steps above are an example of one way of determining the required ribs 60 to obtain the desired longitudinal stiffness profile. Those skilled in the art may devise of ways of calculating the required ribs 60, using a variety of computer programs, analytical solutions, or empirical data, or any combination thereof. Such variations in the above determination should be considered equivalent and within the scope of the present invention.

Figure 8:
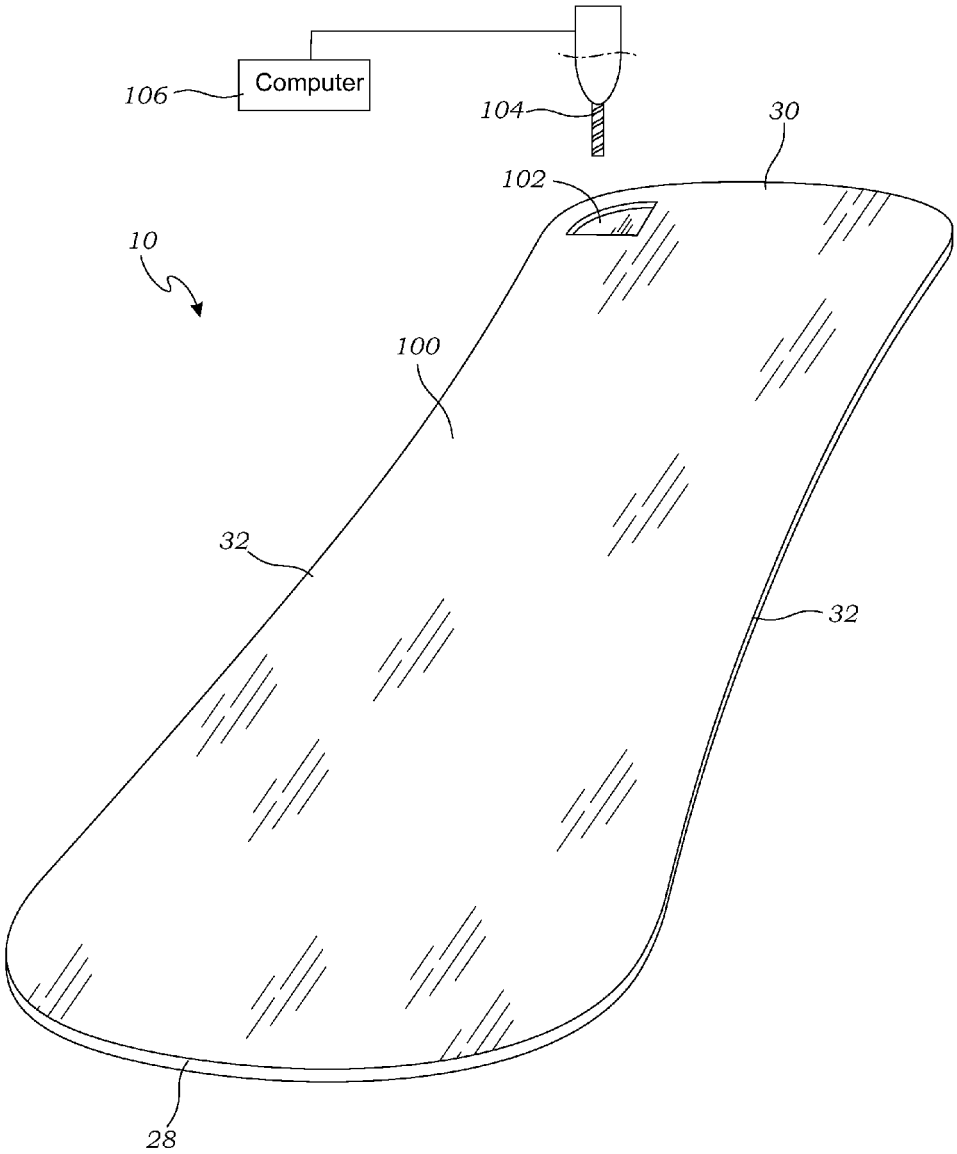
FIG. 8 is a perspective drawing of the sports board prior to the formation of the plurality of ribs.

FIG. 8 is a perspective drawing of a blank board 100 that is in the process of being milled to form the sports board 10 described above. As shown in FIG. 8, in this embodiment a recess 102 is cut in the blank board 100 with a tool 104 (e.g., a CNC machine) as directed by a computer 106. The computer 106 (or another computing device) may be used to calculate the cutter path(s) to mill the plurality of ribs 60, in particular, the size, shape, and position of the plurality of ribs 60 needed to impart the desired stiffness profile. Then, removing material from the blank board 100 forms the plurality of ribs 60 described above. Once the blank board 100 has been milled to form the plurality of ribs 60, it may be further formed by bending, rolling, or other means known to those skilled in the art for introducing an upturning (or downturning) of the front end 28 or the back end 30, or introducing any kind of camber, rocker, or other bending as desired by the board designer. An example of an upturned front end 28 and upturned back end 30 may be seen in the embodiment of FIGS. 1-4. The particular shape, degree of bending, or other shaping may vary as desired by the board designer.

As illustrated in FIGS. 1-8, the method may also include steps for determining the size, shape, and position of the ribs 60. These steps may include:

a) determining a desired stiffness distribution;

b) calculating the required area moment of inertia for any cross-section of the sports board 10;

c) creating a cross-sectional shape of the sports board 10;

d) calculating the area moment of inertia of the current cross-sectional shape;

e) modifying the cross-sectional shape in an iterative manner with steps c)-e) until the moment of inertia matches the required value; and f) repeating steps b)-d) as needed until the desired stiffness distribution is obtained, resulting in a set of the ribs 60 needed to be formed on the sports board 10 to give the desired stiffness distribution.

There may be other steps in the manufacture of the sports board 10, for providing additional features or improvements. One step may be to form the binding attachment structure 50 on or in the board body 20. Another step may be to add to the bottom surface 24, the coating 70 that creates a coefficient of friction between the coating 70 and ice which is less than the coefficient of friction between the ice and the bottom surface 24 without the coating 70, and wherein the coefficient of friction between the coating 70 and ice is greater than zero. Yet another step may be to provide the top body portion 90 and the bottom body portion 92 and attaching the top body portion 90 and the bottom body portion 92 together to form a single unit.

The above described method steps are not to be considered exclusive or restricting, and any combination of steps thereof may be used in the construction of a variety of embodiments of the sports board 10.

Reference is made throughout the application to the coefficient of friction of the sports board 10. In one embodiment, the sports board 10 will have a low coefficient of friction, both static and dynamic, when on snow, to allow the board to easily slide and be ridden by a user. Frictional coefficients are generally difficult to calculate in all situations, for example, an aluminum sports board 10 on an ice surface will have a different coefficient of friction if a thin water layer is present, or if the surface in contact with the ice is polished or finished in different ways. The coefficients of friction given in the present application are intended to quantify a condition of the bottom of the sports board 10 where the sports board 10 will easily slide and have a suitable acceleration under typical conditions and with a typical rider, as known to one skilled in the art. The addition of the coating 70, which reduces the coefficient of friction, describes an embodiment where the sports board 10 has a higher acceleration (or lower deceleration) under the same conditions.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A method for manufacturing a sports board, the method comprising the steps of:

providing a blank board body having a front end and a back end extending along a longitudinal axis, and opposed side edges that are separated along a transverse axis perpendicular to the longitudinal axis;

calculating the size, shape, and position of a plurality of ribs needed to impart a desired stiffness profile to the sports board;

removing material from the blank board body to form a board body having the plurality of ribs collectively having longitudinal portions and transverse portions which provide the desired stiffness profile; and further comprising the steps of:

a) determining a desired stiffness distribution;

b) calculating the required area moment of inertia for any cross-section of the sports board;

c) creating a cross-sectional shape of the sports board;

d) calculating the area moment of inertia of the current cross-sectional shape;

e) modifying the cross-sectional shape in an iterative manner with steps c)-e) until the moment of inertia matches the required value; and f) repeating steps b)-d) as needed until the desired stiffness distribution is obtained, resulting in a set of the ribs needed to be formed on the sports board to give the desired stiffness distribution.

2. The method of claim 1, further comprising the step of:

forming a binding attachment structure on or in the board body.

3. The method of claim 1, further comprising the step of:

adding to the bottom surface, a coating that creates a coefficient of friction between the coating and the snow which is less than the coefficient of friction between the snow and the bottom surface without the coating.

4. The method of claim 1, further comprising the steps of:

providing a top body portion and a bottom body portion;

forming the plurality of ribs in the top body portion; and attaching the top body portion and the bottom body portion together to form the board body.

5. The method of claim 1, further comprising the step of:

bending at least one portion of the board body to bend away from the plane defined by the longitudinal axis and the transverse axis.

6. A sports board for riding on snow, the sports board comprising:

a board body having a top surface and an opposed bottom surface that extend to a perimeter, the sports board having a front end and a back end extending along a longitudinal axis, and opposed side edges that are separated along a transverse axis perpendicular to the longitudinal axis;

a binding attachment structure formed on or in the board body;

a plurality of ribs collectively having longitudinal portions and transverse portions each having a thickness and a height that are predetermined to provide the sports board with a preselected longitudinal stiffness, transverse stiffness, and torsional stiffness optimized for riding on the snow; and wherein the board body is aluminum, wherein the bottom surface has a coating that is suitable for sliding on the snow, and wherein the coating is polytetrafluoroethylene applied after the bottom surface has been anodized.

7. The method of claim 1, further comprising the steps of:

providing a top body portion and a bottom body portion;

forming the plurality of ribs in the bottom body portion; and attaching the top body portion and the bottom body portion together to form the board body.

* * * * *